US008536476B2

(12) United States Patent
Chen

(10) Patent No.: US 8,536,476 B2
(45) Date of Patent: Sep. 17, 2013

(54) ILLUMINATED KEYBOARD

(75) Inventor: Chung-Yuan Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 218 days.

(21) Appl. No.: 13/159,717

(22) Filed: Jun. 14, 2011

(65) Prior Publication Data

US 2012/0285807 A1 Nov. 15, 2012

(30) Foreign Application Priority Data

May 13, 2011 (TW) ..... 100116784 A

(51) Int. Cl.
*H01H 9/00* (2006.01)

(52) U.S. Cl.
USPC ..... 200/310

(58) Field of Classification Search
USPC ..... 200/5 R, 5 A, 46, 406, 511–514, 200/520–521, 308, 310–314, 317, 337, 341, 200/345
See application file for complete search history.

(56) References Cited

U.S. PATENT DOCUMENTS

| | | | | |
|---|---|---|---|---|
| 6,917,000 | B2 * | 7/2005 | Yen | 200/5 A |
| 7,589,292 | B2 * | 9/2009 | Jung et al. | 200/512 |
| 7,608,792 | B1 * | 10/2009 | Tsai | 200/310 |
| 7,952,043 | B2 * | 5/2011 | Lin | 200/310 |
| 2010/0128427 | A1 * | 5/2010 | Iso | 361/679.9 |
| 2011/0089011 | A1 * | 4/2011 | Ozaki | 200/512 |
| 2011/0272262 | A1 * | 11/2011 | Chen | 200/5 A |

* cited by examiner

*Primary Examiner* — Edwin A. Leon
*Assistant Examiner* — Anthony R. Jimenez
(74) *Attorney, Agent, or Firm* — Kirton McConkie; Evan R. Witt

(57) ABSTRACT

An illuminated keyboard includes plural keys, a membrane switch circuit member and an illumination module. The illumination module is used for emitting plural light beams. When the membrane switch circuit member is triggered by depressing a key, the membrane switch circuit member issues a corresponding key signal. The membrane switch circuit member includes plural light-guiding zones. Each of the light-guiding zones is filled with the corresponding light-guiding layer, so that no vacant space is formed in the light-guiding zone. As a consequence, the light-guiding layer is structurally rigid, and the possibility of abrading the light-guiding layer is minimized.

11 Claims, 7 Drawing Sheets

ILLUMINATED KEYBOARD

FIELD OF THE INVENTION

The present invention relates to a keyboard, and more particularly to an illuminated keyboard with an illuminating function.

BACKGROUND OF THE INVENTION

A keyboard is one of the widely-used computer peripheral devices. Via the keyboard, the user may input characters and instructions into a computer. FIG. 1 is a schematic top view illustrating the outward appearance of a conventional keyboard. The surface of the conventional keyboard 1 includes plural keys. These keys 10 are classified into several types, e.g. ordinary keys 101, numeric keys 102 and function keys 103. When one or more keys are depressed by a user, a corresponding signal is issued to the computer, and thus the computer executes a function corresponding to the depressed key or keys. For example, when an ordinary key 101 is depressed, a corresponding English letter or symbol is inputted into the computer. When a numeric key 102 is depressed, a corresponding number is inputted into the computer. In addition, the function keys 102 (F1~F12) can be programmed to cause corresponding application programs to provide certain functions.

With the maturity of the computing technologies, the conventional keyboard that has basic functions fails to meet the requirements of various users. For this reason, the keyboard manufacturers make efforts in designing novel keyboards with diversified functions. Recently, an illuminated keyboard with an illuminating function has been disclosed. Since the outward appearance of the conventional illuminated keyboard is similar to the outward appearance of the conventional keyboard 1, only the inner structure of the conventional illuminated keyboard will be illustrated in more details as follows.

FIG. 2 is a schematic cross-sectional view illustrating a conventional illuminated keyboard. As shown in FIG. 2, the illuminated keyboard 2 comprises plural keys 20, a membrane switch circuit member 21, a light guide plate 22, an illumination module 23, a main circuit board 24, a reflector 25 and a base plate 26. The key 20 comprises a keycap 201, a key housing 202 and an elastic element 203. From top to bottom, the keycap 201, the key housing 202, the elastic element 203, the membrane switch circuit member 21, the light guide plate 22, the reflector 25 and the base plate 26 of the conventional illuminated keyboard 2 are sequentially shown. The main circuit board 24 is arranged at a second side of the membrane switch circuit member 21. The illumination module 23 is arranged at a first side of the membrane switch circuit member 21.

In the key 20, the keycap 201 is exposed outside the surface of the illuminated keyboard 2, so that the keycap 201 can be depressed by the user. The key housing 202 is used for fixing the keycap 201 and the elastic element 203. The elastic element 203 is penetrated through the key housing 202. In addition, both ends of the elastic element 203 are contacted with the keycap 201 and the membrane switch circuit member 21, respectively. The membrane switch circuit member 21 comprises an upper wiring board 211, a partition plate 212 and a lower wiring board 213. The upper wiring board 211, the partition plate 212 and the lower wiring board 213 are made of a transparent material. The transparent material includes for example polycarbonate (PC) or polyethylene (PE). The upper wiring board 211 has plural upper contacts 2111. The partition plate 212 is disposed under the upper wiring board 211, and comprises plural partition plate openings 2121 corresponding to the plural upper contacts 2111. The lower wiring board 213 is disposed under the partition plate 212, and comprises plural lower contacts 2131 corresponding to the plural upper contacts 2111. The plural lower contacts 2131 and the plural upper contacts 2111 are collectively defined as plural key intersections. Moreover, the membrane switch circuit member 21 is connected with the main circuit board 24 for transmitting first electric power and signals.

The illumination module 23 comprises an illumination circuit board 231 and plural light emitting diodes 232. For clarification and brevity, only a light emitting diode 232 is shown in the drawing. The illumination circuit board 231 is arranged at the first side of the membrane switch circuit member 21 for providing second electric power to the plural light emitting diodes 232. The light guide plate 22 has plural light-guiding zones 221. Each of the light-guiding zones 221 has plural light-guiding dots 2211. The light-guiding dots 2211 of each light-guiding zone 221 are uniformly distributed. In addition, each light-guiding zone 221 has plural gaps G. For clarification and brevity, only a gap G is shown in the drawing. The light-guiding dots 2211 are used for guiding the plural light beams to the keycaps 201. A process of forming the light-guiding dots 2211 will be illustrated as follows.

Firstly, a stencil with plural mesh openings is placed on a bottom surface 222 of the light guide plate 22. Then, light-guiding ink is poured to the stencil such that the light-guiding ink flows to the bottom surface 222 of the light guide plate 22 through the mesh openings. Then, the light-guiding ink is subject to a screen printing process, so that the light-guiding ink is printed on the bottom surface 222 of the light guide plate 22 to result in plural light-guiding dots 2211. As shown in FIG. 3, each of the light-guiding zones 221 that is formed by using the stencil with plural mesh openings comprises plural light-guiding dots 2211, wherein every two light-guiding dots 2211 are spaced from each other by the gap G.

As shown in FIG. 2, the reflector 25 of the illuminated keyboard 2 is disposed under the light guide plate 22 for reflecting the light beams. The base plate 26 is disposed under the reflector 25 for supporting the keycap 201, the key housing 202, the elastic element 203, the membrane switch circuit member 21, the light guide plate 22 and the reflector 25.

In the conventional illuminated keyboard 2, the keycap 201 has a light-transmissible region 2011. The light-transmissible region 2011 is located at a character region or a symbol region of the keycap 201. Moreover, the position of the light-transmissible region 2011 is aligned with a corresponding light-guiding zone 221 of the light guide plate 22. In such way, the light beams can be guided to the light-transmissible region 2011 through the light-guiding dots 2211 of the light-guiding zone 221, thereby illuminating the character region or the symbol region of the keycap 201. Consequently, the illuminating efficacy is achieved.

However, after the conventional illuminated keyboard 2 is used for a long time, some drawbacks occur. For example, since the plural keys 20 are frequently depressed, the light-guiding dots 2211 of the light guide plate 22 will be suffered from abrasion. Since there is a vacant space G between adjacent light-guiding dots 2211, the possibility of abrading the peripheries of the light-guiding dots 2211 will be increased. In addition, the abrasion at the periphery of the light-guiding zone 221 becomes more serious. Under this circumstance, these light-guiding dots 2211 fail to be uniformly distributed, and thus the light-guiding efficacy thereof is deteriorated.

SUMMARY OF THE INVENTION

The present invention provides an illuminated keyboard for reducing the possibility of deteriorating the light-guiding efficacy.

In accordance with an aspect of the present invention, there is provided an illuminated keyboard. The illuminated keyboard includes plural keys, a membrane switch circuit member, an illumination module and a light guide plate. The membrane switch circuit member has plural key intersections corresponding to the plural keys. The illumination module is arranged at a first side of the membrane switch circuit member for emitting plural light beams. The light guide plate is stacked on the membrane switch circuit member and disposed under the membrane switch circuit member. The light guide plate has plural light-guiding zones corresponding to the plural key intersections. The plural light-guiding zones are formed on a bottom surface of the light guide plate and arranged beside respective key intersections for guiding the plural light beams to the plural keys. Each of the light-guiding zones includes a light-guiding layer. The light-guiding zone is filled with the corresponding light-guiding layer, so that no vacant space is formed in the light-guiding zone.

In an embodiment, each of the light-guiding layers is made of light-guiding ink, and each of the light-guiding zones is filled with the light-guiding ink.

In an embodiment, the illuminated keyboard further includes a main circuit board and a base plate. The main circuit board is connected with the membrane switch circuit member for providing first electric power to the membrane switch circuit member . The base plate is disposed under the light guide plate for supporting the plural keys, the membrane switch circuit member, the illumination module, the light guide plate and the main circuit board.

In an embodiment, the illumination module includes an illumination circuit board and plural light emitting diodes. The illumination circuit board is arranged at the first side of the membrane switch circuit member for providing second electric power. The plural light emitting diodes are mounted on the illumination circuit board for acquiring the second electric power, thereby emitting the plural light beams.

In an embodiment, the membrane switch circuit member includes an upper wiring board, a partition plate and a lower wiring board. The upper wiring board has plural upper contacts. The partition plate is disposed under the upper wiring board, and has plural partition plate openings corresponding to the plural upper contacts. When the membrane switch circuit member is depressed, a corresponding upper contact is inserted into a corresponding partition plate opening. The lower wiring board is disposed under the partition plate, and has plural lower contacts corresponding to the plural upper contacts, wherein the plural lower contacts and the plural upper contacts are collectively defined as the plural key intersections.

In accordance with another aspect of the present invention, there is provided an illuminated keyboard. The illuminated keyboard includes plural keys, a membrane switch circuit member and an illumination module. The membrane switch circuit member has plural key intersections corresponding to the plural keys and plural light-guiding zones corresponding to the plural key intersections. The plural light-guiding zones are formed on a bottom surface of the light guide plate. Each of the light-guiding zones includes a light-guiding layer. The light-guiding zone is filled with the corresponding light-guiding layer, so that no vacant space is formed in the light-guiding zone. The illumination module is arranged at a first side of the membrane switch circuit member for emitting plural light beams. The plural light beams are projected on the plural light-guiding zones and guided to the plural keys by the plural light-guiding zones.

In an embodiment, each of the light-guiding layers is made of light-guiding ink, and each of the light-guiding zones is filled with the light-guiding ink.

In an embodiment, the membrane switch circuit member includes an upper wiring board, a partition plate and a lower wiring board. The upper wiring board has plural upper contacts. The partition plate is disposed under the upper wiring board, and has plural partition plate openings corresponding to the plural upper contacts. When the membrane switch circuit member is depressed, a corresponding upper contact is inserted into a corresponding partition plate opening. The lower wiring board is disposed under the partition plate, and has plural lower contacts corresponding to the plural upper contacts and the plural light-guiding zones. The plural lower contacts and the plural upper contacts are collectively defined as the plural key intersections. The plural light-guiding zones are formed on a bottom surface of the lower wiring board. In an embodiment, the illuminated keyboard further includes a main circuit board and a base plate. The main circuit board is connected with the membrane switch circuit member and the illumination module for providing first electric power to the membrane switch circuit member and the illumination module. The base plate is disposed under the membrane switch circuit member for supporting the plural keys and the membrane switch circuit member.

In an embodiment, each of the keys includes a keycap, a scissors-type connecting element and an elastic element. The keycap is exposed to a surface of the illuminated keyboard, and includes a light-transmissible region corresponding to one of the plural light-guiding zones. The scissors-type connecting element is arranged between the base plate and the keycap for connecting the base plate and the keycap, and allowing the keycap to be moved upwardly and downwardly with respect to the base plate. The elastic element is arranged between the membrane switch circuit member and the keycap. When the keycap is pressed, the elastic element is compressed to push against the membrane switch circuit member, so that a corresponding upper contact is contacted with a corresponding lower contact. Whereas, when a depressing force exerted on the keycap is eliminated, an elastic force provided by the elastic element is acted on the keycap, so that the keycap is returned to an original position.

In an embodiment, the illumination module includes an illumination circuit board and plural light emitting diodes. The illumination circuit board is arranged at the first side of the membrane switch circuit member for providing second electric power. The plural light emitting diodes are mounted on the illumination circuit board for acquiring the second electric power, thereby emitting the plural light beams.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
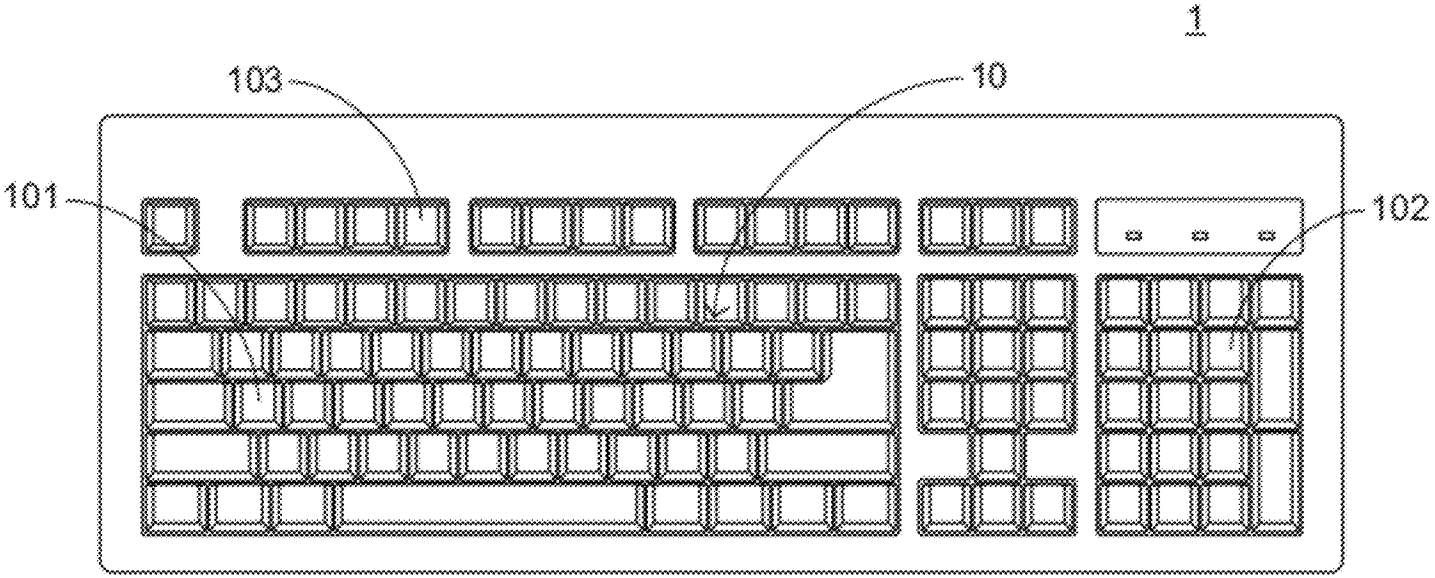
FIG.1 PRIOR ART
FIG. 1 is a schematic top view illustrating the outward appearance of a conventional keyboard.
Figure 2:
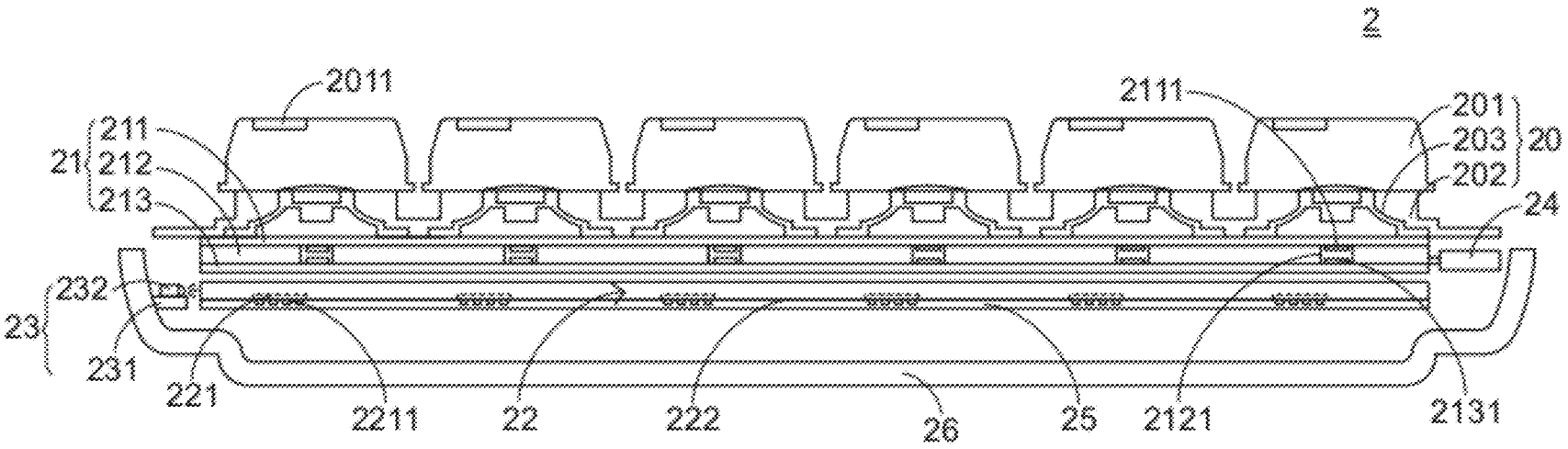
FIG.2 PRIOR ART
FIG. 2 is a schematic cross-sectional view illustrating a conventional illuminated keyboard.
Figure 3:
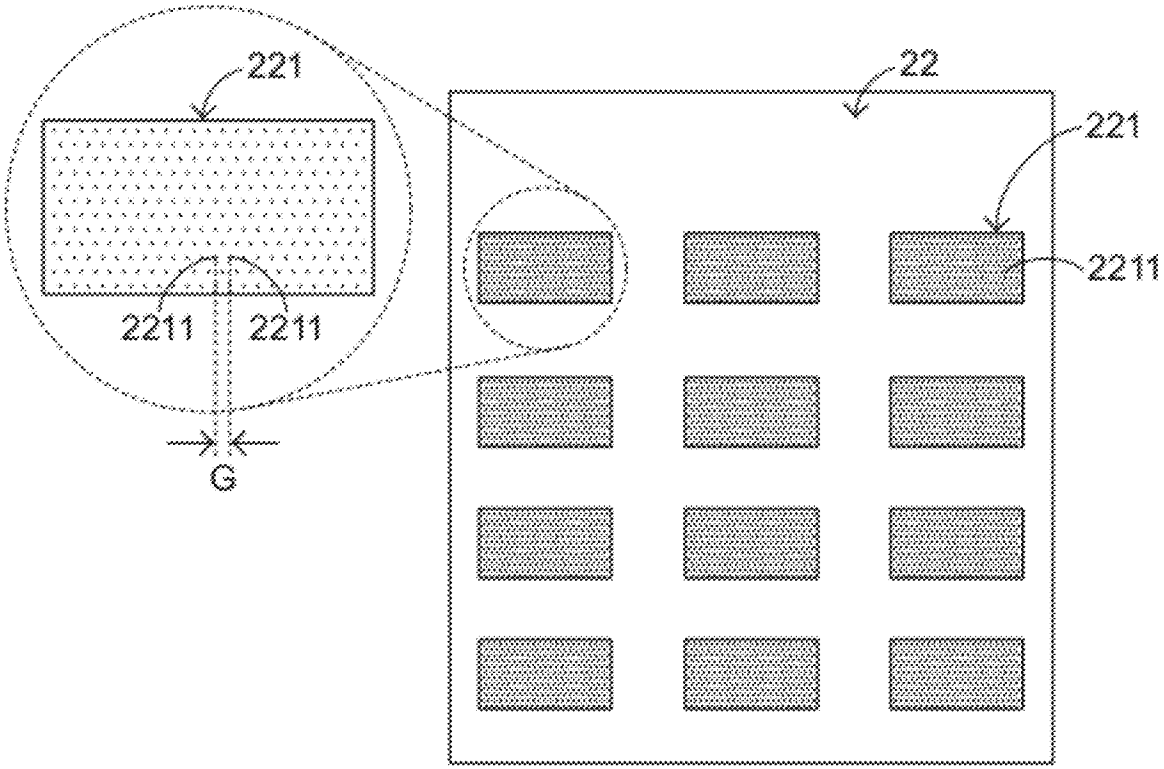
FIG.3 PRIOR ART
FIG. 3 is a schematic top view illustrating a light guide plate of a conventional illuminated keyboard.
Figure 4:
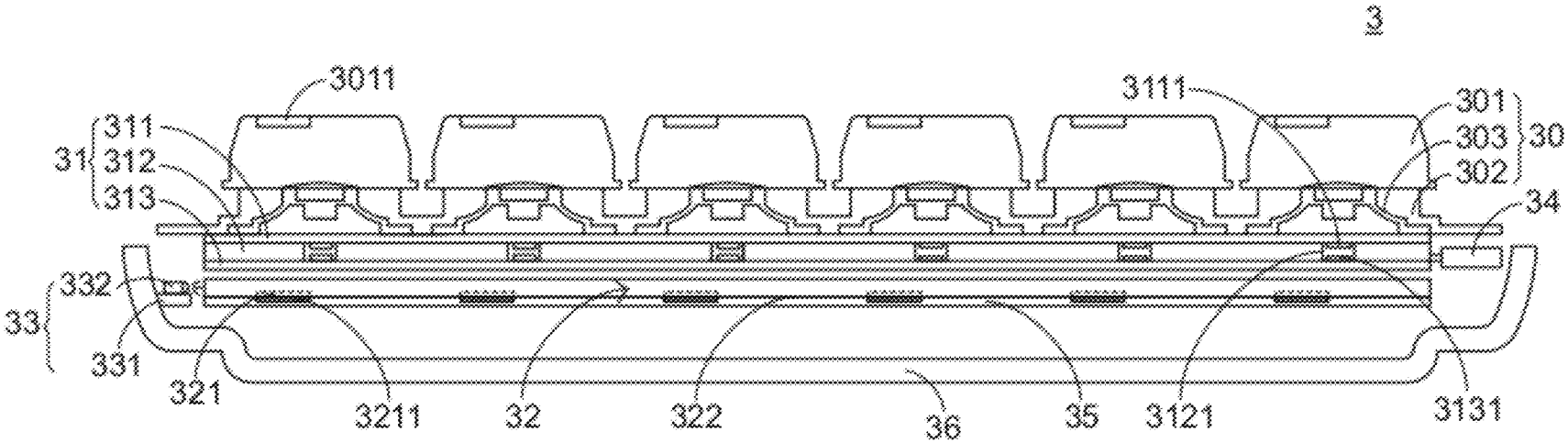
FIG. 4 is a schematic cross-sectional view illustrating an illuminated keyboard according to a first embodiment of the present invention.

For obviating the drawbacks encountered from the prior art, the present invention provides illuminated keyboard. FIG. 4 is a schematic cross-sectional view illustrating an illuminated keyboard according to a first embodiment of the present invention. As shown in FIG. 4, the illuminated keyboard comprises plural keys 30, a membrane switch circuit member 31, a light guide plate 32, an illumination module 33, a main circuit board 34, a reflector 35 and a base plate 36. The key 30 comprises a keycap 301, a key housing 302 and an elastic element 303. From top to bottom, the keycap 301, the key housing 302, the elastic element 303, the membrane switch circuit member 31, the light guide plate 32, the reflector 35 and the base plate 36 of the conventional illuminated keyboard 3 are sequentially shown. The main circuit board 34 is arranged at a second side of the membrane switch circuit member 31. The illumination module 33 is arranged at a first side of the membrane switch circuit member 31. In this embodiment, the illuminated keyboard 3 is a keyboard for a desktop computer. The first side of the membrane switch circuit member 31 denotes the front side of the membrane switch circuit member 31, i.e. the side of the illuminated keyboard 3 having the space bar. The second side of the membrane switch circuit member 31 denotes the rear side of the membrane switch circuit member 31, i.e. the side of the illuminated keyboard 3 having the function key F1.

In the key 30, the keycap 301 is exposed outside the surface of the illuminated keyboard 3, so that the keycap 301 can be depressed by the user. In addition, the keycap 301 has a light-transmissible region 3011. The light-transmissible region 3011 is located at a character region or a symbol region of the keycap 301. The key housing 302 is used for fixing the keycap 301 and the elastic element 303. The elastic element 303 is penetrated through the key housing 302. In addition, both ends of the elastic element 303 are contacted with the keycap 301 and the membrane switch circuit member 31, respectively. In this embodiment, the elastic element 303 is made of a transparent rubbery material. Moreover, the membrane switch circuit member 31 is connected with the main circuit board 34 for transmitting first electric power and signals.

Figure 5:
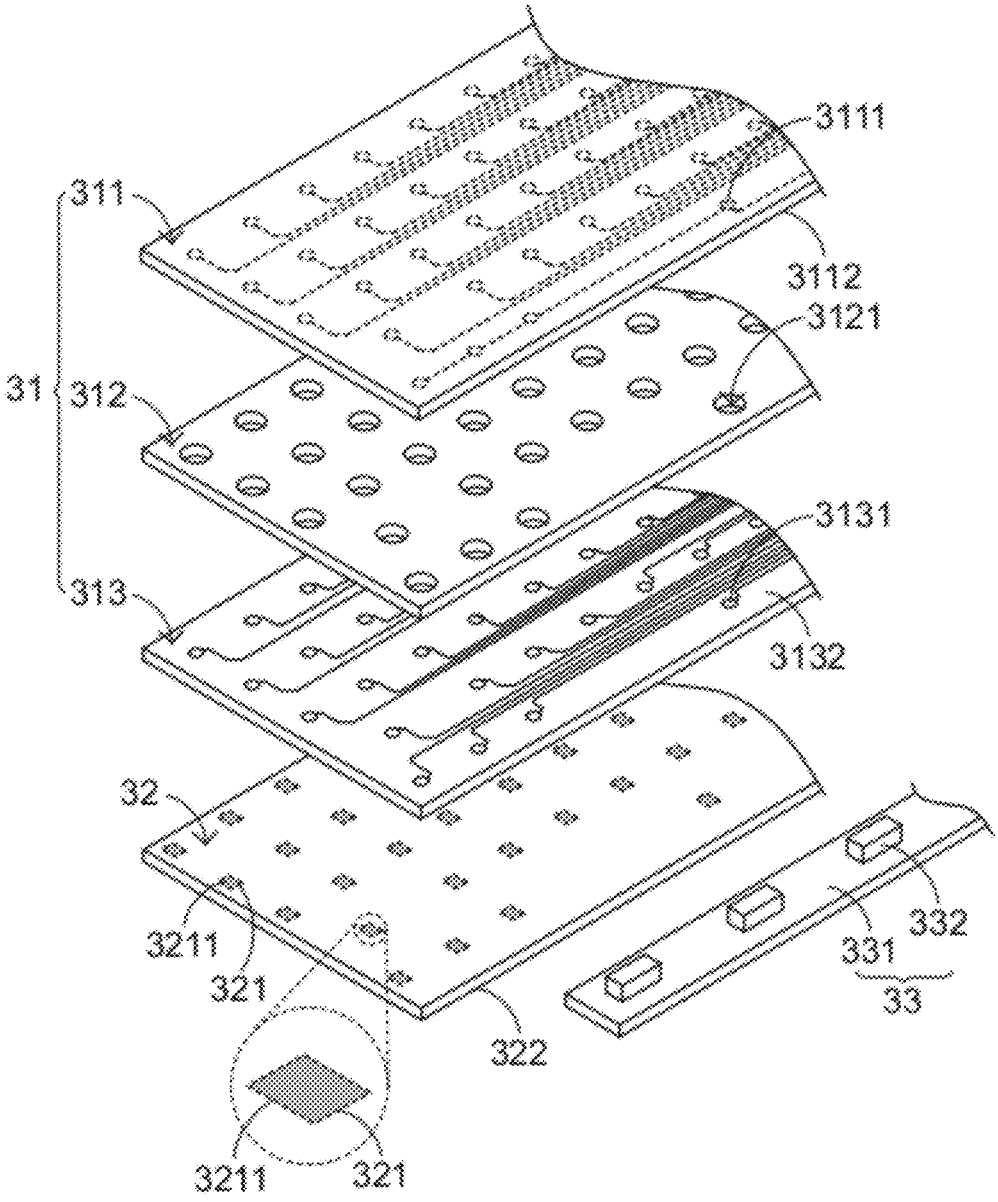
FIG. 5 is a schematic exploded view illustrating the membrane switch circuit member, the light guide plate and the illumination module of the illuminated keyboard according to the first embodiment of the present invention.

FIG. 5 is a schematic exploded view illustrating the membrane switch circuit member, the light guide plate and the illumination module of the illuminated keyboard according to the first embodiment of the present invention. The membrane switch circuit member 31 comprises an upper wiring board 311, a partition plate 312 and a lower wiring board 313. The upper wiring board 311 has plural upper contacts 3111. The partition plate 312 is disposed under the upper wiring board 311, and comprises plural partition plate openings 3121 corresponding to the plural upper contacts 3111. The lower wiring board 313 is disposed under the partition plate 312, and comprises plural lower contacts 3131 corresponding to the plural upper contacts 3111. The plural lower contacts 3131 and the plural upper contacts 3111 are collectively defined as plural key intersections. In this embodiment, the upper wiring board 311, the partition plate 312 and the lower wiring board 313 are made of a transparent material such as polycarbonate (PC) or polyethylene (PE).

Please refer to FIGS. 4 and 5 again. The illumination module 33 comprises an illumination circuit board 331 and plural light emitting diodes 332. The illumination circuit board 331 is arranged at the first side of the membrane switch circuit member 31 for providing second electric power to the plural light emitting diodes 332. The plural light emitting diodes 332 are mounted on the illumination circuit board 331. By acquiring the second electric power, the plural light emitting diodes 332 are enabled to emit plural light beams. In this embodiment, the plural light emitting diodes 332 are side-view light emitting diodes. Each of the light-guiding zones 321 comprises a light-guiding layer 3211. The light-guiding zone 321 is filled with the corresponding light-guiding layer 3211, so that no vacant space is formed in the light-guiding zone 321. By the light-guiding layer 3211, the plural light beams are guided to the keycaps 301 and transmitted through the light-transmissible regions 3011. In this embodiment, the light-guiding zones 321 and the light-guiding layers 3211 are all rectangular. The process of forming each of the light-guiding layers 3211 is similar to the process of forming the conventional light-guiding dots. Firstly, a stencil with plural rectangular openings is placed on a bottom surface 322 of the light guide plate 32. Then, light-guiding ink is poured to the stencil such that the light-guiding ink flows to the bottom surface 322 of the light guide plate 32 through the plural rectangular openings. Then, the light-guiding ink is subject to a screen printing process, so that the light-guiding ink is printed on the bottom surface 322 of the light guide plate 32 to result in plural rectangular light-guiding layers 3211. Since the light-guiding layer 3211 is formed by completely filling the rectangular opening with the light-guiding ink, the light-guiding zone 321 is filled with the corresponding light-guiding layer 3211. Under this circumstance, no vacant space is formed in the light-guiding zones 321.

As shown in FIG. 4, the reflector 35 is disposed under the light guide plate 32 for reflecting the light beams. The base plate 36 is disposed under the reflector 35 for supporting the keycap 301, the key housing 302, the elastic element 303, the membrane switch circuit member 31, the light guide plate 32 and the reflector 35. After the above components are combined together, the illuminated keyboard 3 is assembled. When the keycap 301 is depressed by a user, the keycap 301 is moved downwardly with respect to the key housing 302. At the same time, the elastic element 303 is compressed to push against the membrane switch circuit member 31, so that the upper contact 3111 is inserted into a corresponding partition plate opening 3121 to be contacted with a corresponding lower contact 3131. Under this circumstance, a corresponding key intersection of the membrane switch circuit member 31 is triggered to generate a key signal. Whereas, when the depressing force exerted on the key 301 is eliminated, an elastic force provided by the elastic element 303 is acted on the keycap 301. Due to the elastic force, the keycap 301 is returned to its original position. After the plural light beams emitted by the plural light emitting diodes 322 of the illumination module 32 are directed to the light guide plate 32, some of the light beams are guided to the light-transmissible regions 3011 of the keycaps 301 by the light-guiding layers 3211 of the light guide plate 32. At the same time, some of the light beams are reflected by the reflector 35 under the light guide plate 32, and the reflected light beams are directed to the light-guiding layers 3211 again to be guided by the light-guiding layers 3211.

From the above description, the light-guiding layer 3211 is an integral rectangular layer. In other words, the peripheries of the light-guiding layer 3211 are the four sides of the rectangle. In comparison with the light-guiding dots 2211 of the light-guiding zone 221, since the rectangular light-guiding layer 3211 has no vacant space, the peripheries of the light-guiding layer 3211 are the four sides of the rectangle. Moreover, since the peripheries of the light-guiding layer 3211 are smaller than the peripheries of the plural light-guiding dots 2211, the possibility of abrading the light-guiding layer 3211 through a long-term collision will be reduced. Moreover, since the light-guiding layer 3211 is rectangular and the stencil for performing the screen printing process have the same size of rectangular openings as the light-guiding zones 321, the rectangular openings can be easily filled with the light-guiding ink during the printing process. Moreover, after the printing process is finished, the light-guiding ink is seldom retained in the stencil with the rectangular openings. On contrast, since the conventional stencil for forming the light-guiding dots has small mesh openings, the light-guiding ink is easily retained in the stencil. Moreover, in a case that the conventional stencil with the small mesh openings is repeatedly used, a portion of the light-guiding ink to be printed on the light-guiding zone may be adsorbed or bonded by the residual light-guiding ink of the stencil. Under this circumstance, the light-guiding ink printed on the light-guiding zone is insufficient, and thus the light-guiding efficacy thereof is deteriorated. On the other hand, since stencil of the present invention for printing the light-guiding ink has larger-sized rectangular openings, the light-guiding ink is rarely retained in the stencil during the process of forming the light-guiding layer. Since the light-guiding ink is filled with the light-guiding zone, the light-guiding efficacy is enhanced. In addition, the production yield during the printing process is increased, and the fabricating cost is reduced.

Figure 6:
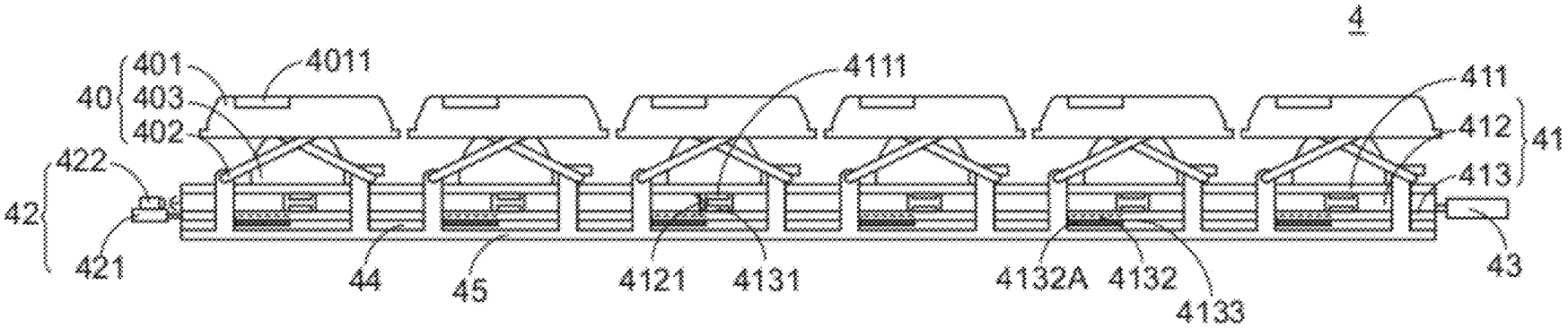
FIG. 6 is a schematic cross-sectional view illustrating an illuminated keyboard according to a second embodiment of the present invention.

The present invention further provides an illuminated keyboard of a second embodiment. FIG. 6 is a schematic cross-sectional view illustrating an illuminated keyboard according to a second embodiment of the present invention. As shown in FIG. 6, the illuminated keyboard 4 comprises plural keys 40, a membrane switch circuit member 41, an illumination module 42, a main circuit board 43, a reflector 44 and a base plate 45. The key 40 comprises a keycap 401, a scissors-type connecting element 402 and an elastic element 403. From top to bottom, the keycap 401, the scissors-type connecting element 402, the elastic element 403, the membrane switch circuit member 41, the reflector 44 and the base plate 45 of the illuminated keyboard 4 are sequentially shown. The illumination module 42 is arranged at a first side of the membrane switch circuit member 41. The main circuit board 43 is arranged at a second side of the membrane switch circuit member 41. In this embodiment, the illuminated keyboard 4 is a keyboard for a notebook computer. The first side of the membrane switch circuit member 41 denotes the front side of the membrane switch circuit member 41, i.e. the side of the illuminated keyboard 4 having the space bar. The second side of the membrane switch circuit member 41 denotes the rear side of the membrane switch circuit member 41, i.e. the side of the illuminated keyboard 4 having the function key F1.

In the key 40, the keycap 401 is exposed outside the surface of the illuminated keyboard 4, so that the keycap 401 can be depressed by the user. In addition, the keycap 401 has a light-transmissible region 4011. The light-transmissible region 4011 is located at a character region or a symbol region of the keycap 401. The scissors-type connecting element 402 is connected with the keycap 401 and the base plate 45. The elastic element 403 is penetrated through the scissors-type connecting element 402. In addition, both ends of the elastic element 403 are contacted with the keycap 401 and the membrane switch circuit member 41, respectively. Moreover, the membrane switch circuit member 41 is connected with the main circuit board 43 for transmitting first electric power and signals.

Figure 7:
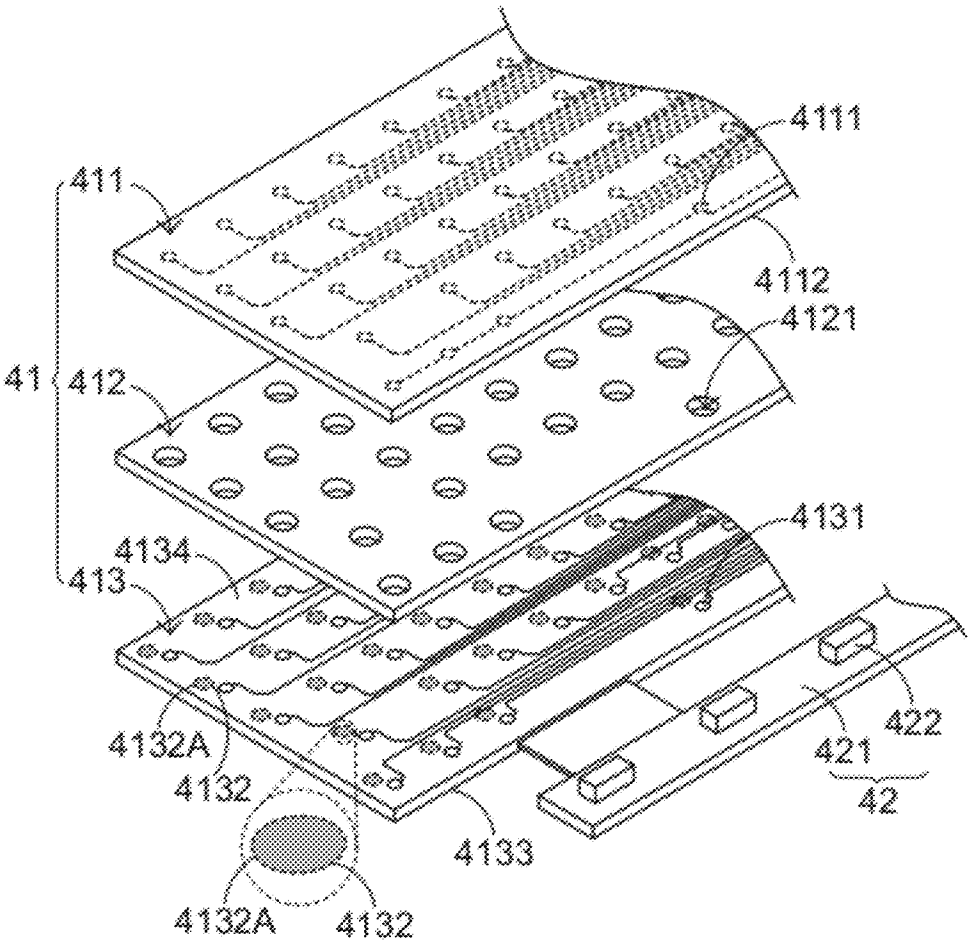
FIG. 7 is a schematic exploded view illustrating the membrane switch circuit member and the illumination module of the illuminated keyboard according to the second embodiment of the present invention.

FIG. 7 is a schematic exploded view illustrating the membrane switch circuit member and the illumination module of the illuminated keyboard according to the second embodiment of the present invention. The membrane switch circuit member 41 comprises an upper wiring board 411, a partition plate 412 and a lower wiring board 413. The upper wiring board 411 has plural upper contacts 4111. The partition plate 412 is disposed under the upper wiring board 411, and comprises plural partition plate openings 4121 corresponding to the plural upper contacts 4111. The lower wiring board 413 is disposed under the partition plate 412, and comprises plural lower contacts 4131 corresponding to the plural upper contacts 4111 and plural light-guiding zones 4132 corresponding to the plural lower contacts 4131. The plural lower contacts 4131 and the plural upper contacts 4111 are collectively defined as plural key intersections. Each of the light-guiding zones 4132 comprises a light-guiding layer 4132A. The light-guiding zone 4132 is filled with the corresponding light-guiding layer 4132A, so that no vacant space is formed in the light-guiding zone 4132. The light-guiding layers 4132A are used for guiding the plural light beams to the keycaps 401, so that the light beams can be transmitted through the light-transmissible regions 4011 of the keycaps 401. It is noted that portions of the base plate 45 are penetrated through respective openings of the upper wiring board 411, the partition plate 412 and the lower wiring board 413. For cleaning the drawing and facilitating observing the light-guiding layers, the openings to be penetrated through by the base plate 45 are not shown in FIG. 7.

In this embodiment, the light-guiding zones 4132 and the light-guiding layers 4132A are all circular. The upper wiring board 411 and the partition plate 412 are made of a transparent material such as polycarbonate (PC) or polyethylene (PE). Whereas, the lower wiring board 413 is made of a light-guiding material such as polycarbonate (PC) or polymethylmethacrylate (PMMA). The light-guiding layers 4132A are formed by printing light-guiding ink on the bottom surface 4133 of the light lower wiring board 413. The printing process is similar to that of the first embodiment, and is not redundantly described herein.

Please refer to FIGS. 6 and 7. The illumination module 42 comprises an illumination circuit board 421 and plural light emitting diodes 422. The illumination circuit board 421 is arranged at the first side of the membrane switch circuit member 41 for providing second electric power to the plural light emitting diodes 422. The plural light emitting diodes 422 are mounted on the illumination circuit board 421. By acquiring the second electric power, the plural light emitting diodes 422 are enabled to emit plural light beams. In this embodiment, the plural light emitting diodes 422 are side-view light emitting diodes. In this embodiment, the illumination circuit board 421 is a flexible printed circuit (FPC) board. The reflector 44 is disposed under the membrane switch circuit member 41 for reflecting the plural light beams. The base plate 45 is disposed under the reflector 44 and connected with the scissors-type connecting element 402. The base plate 45 is used for supporting the keycap 401, the scissors-type connecting element 402, the elastic element 403, the membrane switch circuit member 41 and the reflector 44. The operations of the illuminated keyboard 4 of this embodiment are similar to those illustrated in the first embodiment, and are not redundantly described herein.

The light-guiding layer 4132A of the illuminated keyboard 4 of this embodiment has benefits similar to the first embodiment. That is, the possibility of abrading the light-guiding layer 4132A is minimized and the fabricating cost of the illuminated keyboard is reduced. On the other hand, since the light-guiding layer 4132A is formed on the on the bottom surface 4133 of the light lower wiring board 413 of the membrane switch circuit member 41 in this embodiment, no additional light guide plate is required. Under this circumstance, the internal thickness of the illuminated keyboard 4, and the internal structure of the illuminated keyboard 4 is simplified. Therefore, the illuminated keyboard 4 is easily assembled and the fabricating cost thereof is reduced.

From the above description, the illuminated keyboard of the present invention utilizes integral light-guiding layers to guide the light beams. Since no vacant space is formed in the light-guiding layer, the light-guiding layer is structurally rigid. In other words, when compared with the conventional light-guiding dots, the possibility of abrading the light-guiding layer is largely reduced and the illuminating efficacy of the illuminated keyboard is satisfied. Moreover, the structure of the light-guiding layer is distinguished when compared with the conventional light-guiding dots. Since the light-guiding ink is rarely retained in the stencil during the process of forming the light-guiding layer, the production yield of the light-guiding layer of the present invention is largely increased when compared with the conventional light-guiding dots.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard, comprising:

plural keys;

a membrane switch circuit member having plural key intersections corresponding to said plural keys;

an illumination module arranged at a first side of said membrane switch circuit member for emitting plural light beams; and a light guide plate stacked on said membrane switch circuit member and disposed under said membrane switch circuit member, wherein said light guide plate has plural light-guiding zones corresponding to said plural key intersections, wherein said plural light-guiding zones are formed on a bottom surface of said light guide plate and arranged beside respective key intersections for guiding said plural light beams to said plural keys, wherein each of said light-guiding zones comprises a light-guiding layer, and each of said light-guiding zones is filled with said corresponding light-guiding layer, so that no vacant space is formed in said light-guiding zones.

2. The illuminated keyboard according to claim 1 wherein each of said light-guiding layers is made of light-guiding ink, and each of said light-guiding zones is filled with said light-guiding ink.

3. The illuminated keyboard according to claim 1 further comprising:

a main circuit board connected with said membrane switch circuit member for providing first electric power to said membrane switch circuit member; and a base plate disposed under said light guide plate for supporting said plural keys, said membrane switch circuit member, said illumination module, said light guide plate and said main circuit board.

4. The illuminated keyboard according to claim 1 wherein said illumination module comprises:

an illumination circuit board arranged at said first side of said membrane switch circuit member for providing second electric power; and plural light emitting diodes mounted on the illumination circuit board for acquiring said second electric power, thereby emitting said plural light beams.

5. The illuminated keyboard according to claim 1 wherein said membrane switch circuit member comprises:

an upper wiring board having plural upper contacts;

a partition plate disposed under said upper wiring board, and having plural partition plate openings corresponding to said plural upper contacts, wherein when said membrane switch circuit member is depressed, a corresponding upper contact is inserted into a corresponding partition plate opening; and a lower wiring board disposed under said partition plate, and having plural lower contacts corresponding to said plural upper contacts, wherein said plural lower contacts and said plural upper contacts are collectively defined as said plural key intersections.

6. An illuminated keyboard, comprising:

plural keys;

a membrane switch circuit member having plural key intersections corresponding to said plural keys and plural light-guiding zones corresponding to said plural key intersections, wherein said plural light-guiding zones are formed on a bottom surface of a light guide plate, wherein each of said light-guiding zones comprises a light-guiding layer, and each of said light-guiding zones is filled with said corresponding light-guiding layer, so that no vacant space is formed in said light-guiding zones; and an illumination module arranged at a first side of said membrane switch circuit member for emitting plural light beams, wherein said plural light beams are projected on said plural light-guiding zones and guided to said plural keys by said plural light-guiding zones.

7. The illuminated keyboard according to claim 6 wherein each of said light-guiding layers is made of light-guiding ink, and each of said light-guiding zones is filled with said light-guiding ink.

8. The illuminated keyboard according to claim 6 wherein said membrane switch circuit member comprises:

an upper wiring board having plural upper contacts;

a partition plate disposed under said upper wiring board, and having plural partition plate openings corresponding to said plural upper contacts, wherein when said membrane switch circuit member is depressed, a corresponding upper contact is inserted into a corresponding partition plate opening; and a lower wiring board disposed under said partition plate, and having plural lower contacts corresponding to said plural upper contacts and said plural light-guiding zones, wherein said plural lower contacts and said plural upper contacts are collectively defined as said plural key intersections, and said plural light-guiding zones are formed on a bottom surface of said lower wiring board.

9. The illuminated keyboard according to claim 6 further comprising:

a main circuit board connected with said membrane switch circuit member and said illumination module for providing first electric power to said membrane switch circuit member and said illumination module; and a base plate disposed under said membrane switch circuit member for supporting said plural keys and said membrane switch circuit member.

10. The illuminated keyboard according to claim 9, wherein each of said keys comprises:

a keycap exposed to a surface of said illuminated keyboard, and comprising a light-transmissible region corresponding to one of said plural light-guiding zones;

a scissors-type connecting element arranged between said base plate and said keycap for connecting said base plate and said keycap, and allowing said keycap to be moved upwardly and downwardly with respect to said base plate; and an elastic element arranged between said membrane switch circuit member and said keycap, wherein when said keycap is pressed, said elastic element is compressed to push against said membrane switch circuit member, so that a corresponding upper contact is contacted with a corresponding lower contact, wherein when a depressing force exerted on said keycap is eliminated, an elastic force provided by said elastic element is acted on said keycap, so that said keycap is returned to an original position.

11. The illuminated keyboard according to claim 6 wherein said illumination module comprises:

an illumination circuit board arranged at said first side of said membrane switch circuit member for providing second electric power; and plural light emitting diodes mounted on the illumination circuit board for acquiring said second electric power, thereby emitting said plural light beams.

* * * * *